United States Patent [19]

Beynet et al.

[11] Patent Number: 4,516,881

[45] Date of Patent: May 14, 1985

[54] MULTITERMINATORS FOR RISER PIPES

[75] Inventors: Pierre A. Beynet, Tulsa, Okla.; J. Thomas von Aschwege, Pinner, England

[73] Assignee: Standard Oil Company, Chicago, Ill.

[21] Appl. No.: 352,496

[22] Filed: Feb. 25, 1982

[51] Int. Cl.[3] ..... E21B 43/01

[52] U.S. Cl. ..... 405/195; 166/367; 403/133; 405/224

[58] Field of Search ..... 405/169, 195, 202, 224, 405/227; 166/350, 359, 367; 285/263; 403/133, 135, 140; 114/264, 265

[56] References Cited

U.S. PATENT DOCUMENTS

| | | | |
|---|---|---|---|
| 939,908 | 11/1909 | Greenlaw | 285/263 |
| 3,142,344 | 7/1964 | Otteman et al. | 166/359 X |
| 4,030,310 | 6/1977 | Schirtzinger | 405/195 |
| 4,127,005 | 11/1978 | Osborne | 405/227 |
| 4,130,995 | 12/1978 | Osborne | 405/224 |
| 4,173,360 | 11/1979 | Bergman et al. | 285/263 X |
| 4,185,694 | 1/1980 | Horton | 166/350 |
| 4,212,561 | 7/1980 | Wipkink | 405/195 |

OTHER PUBLICATIONS

"The Vertically Moored Platform, for Deepwater Drilling and Production", by M. Y. Berman, K. A. Blenkarn, and D. A. Dixon; OTC Paper #3049, Copyright 1978 Offshore Technology Conference.

"Motion, Fatigue, and the Reliability Characteristics of a Vertically Moored Platform", by P. A. Beynet, M. Y. Berman, and J. T. von Aschwege; OTC Paper #3304; Copyright 1978, Offshore Technology Conference.

*Primary Examiner*—David H. Corbin

*Attorney, Agent, or Firm*—Scott H. Brown; Fred E. Hook

[57] ABSTRACT

This invention is an improvement over the simple terminator, which has been applied at the mudline, and at the platform level, to resist very large stresses in the riser pipes when the vertically moored platform (VMP) is subjected to wind, tide and current. A second or short terminator is used with the terminator to form a multiterminator which results in the length and weight of the terminator assembly for a given site being greatly reduced from that of the prior art terminator. Thus, the cost of construction of the terminator assembly is drastically reduced with the use of our invention. Also disclosed is a novel bearing arrangement between the VMP and the terminator assembly.

9 Claims, 6 Drawing Figures

MULTITERMINATORS FOR RISER PIPES

Reference is made to the following publications which provide information regarding the art of vertically moored platforms.

A. The Vertically Moored Platform, for Deepwater Drilling and Production; by M. Y. Berman, K. A. Blenkarn, and D. A. Dixon; OTC Paper #3049, Copyright 1978 Offshore Technology Conference; and B. Motion, Fatigue and the Reliability of Characteristics of a Vertically Moored Platform; by P. A. Beynet, M. Y. Berman, and J. T. von Aschwege; OTC Paper #3304; Copyright 1978, Offshore Technology Conference.

Reference is also made to U.S. Pat. No. 4,127,005 issued Nov. 28, 1978, entitled: "Riser/Jacket Vertical Bearing Assembly for Vertically Moored Platform" and U.S. Pat. No. 4,130,995 issued Dec. 26, 1978, entitled: "VMP Riser Horizontal Bearing". U.S. Pat. Nos. 4,127,005 and 4,130,995 are assigned to the assignee of this application.

BACKGROUND OF THE INVENTION

1. Field of the Invention

This invention lies in the field of vertically moored platforms (VMP) or other floating structures, for offshore, deepwater oil production which are connected to anchors in the sea floor by large diameter pipes commonly called riser pipes. More particularly, it concerns improvements in the manner by which the riser pipes are attached at their upper ends to the floating platform, and at their lower ends to anchor means at the mudline, such as conductor pipe set in holes driven into the sea floor. The riser pipes are maintained in tension at all times. When the platform is directly over the conductor pipes, there is no deflection in the riser pipes, and therefore no lateral stress in the riser pipes. However, as the pressure of wind, tide and current causes the platform to move laterally, there must be a bending of the riser pipes.

2. Description of the Prior Art

The vertically moored platform (VMP) is anchored by vertical pipes called riser pipes, kept under high tension. As the platform and jacket move horizontally, under the influence of wind, wave and current, the riser pipes are deformed. The high tension has a tendency to concentrate the bending deformation in the riser pipes at each end of the risers, where they extend vertically into the ground at the bottom end, and into the platform at the upper end.

These large deformations are detrimental to the risers. To distribute these deformations along the riser pipes, to decrease the maximum stresses, terminators have been designed. The terminators are sections of pipe constructed of varying diameter and wall thickness, the diameter and wall thickness both decrease from a mid-section towards each end, so that the flexibility of the end portions is greater than at the mid portion of the terminator. This variable flexibility introduced into the riser pipe system by the terminator distributes the bending moment and helps appreciably to reduce the maximum stresses in the riser pipes.

Horizontal bearings have been introduced and positioned at the mid-section of the terminator, so that the terminator itself can rotate in a vertical plane throughout its axis, and, therefore, distribute part of the bending above and below the horizontal bearing, which supports the riser.

SUMMARY OF THE INVENTION

We have found that by use of our invention a greater flexibility in angular deflection at the support point (which may for convenience be called rotation) can be provided without decreased stress in the terminator/-riser structure, while permitting the design of a smaller terminator with a consequent saving of construction and installation cost.

It is a primary object of this invention to provide a terminator and terminator extension, for anchoring the VMP or other floating structure to the upper end of each riser pipe, and also to provide a terminator and terminator extension at the lower end of the riser when it connects to anchor means at the sea floor.

It is a further object to provide a novel bearing arrangement for transmitting axial and lateral forces from the riser pipe to the jacket leg. A horizontal bearing is provided at the maximum diameter portions of both the terminator and terminator extension at each end of each riser pipe.

These and other objects are realized and the limitations of the prior art are overcome in this invention by using (a) a terminator and (b) a terminator extension, which when (a) and (b) are combined may be called a "multiterminator" (1) to anchor the upper end of the riser pipe to legs or other appropriate structures of the vertically moored platform and (2) to anchor the lower end of the riser pipe in the conductor pipe at the mudline.

A terminator is a steel tubular device, made of pipe sections of varying length, diameter and wall thickness so that the outer contour of the terminator varies from a cylindrical mid-section, where it is of maximum diameter and selected length, tapering towards both ends. Normally, one end is farther from the largest diameter portion than the other end and consequently tapers more slowly and gradually than does the shorter end. The precise diameters and wall thicknesses vary throughout the length of the tapered portions and are designed to provide a graduated bending as a function of position on either side of the widest portion of the terminator, where it is mounted in an encircling sleeve supported in a leg or jacket of the VMP at the top and supported at the bottom by a pile secured in the earth.

In the terminator of the upper multiterminator, the longest tapered end is directed downwardly and becomes an extension of the riser pipe which continues downwardly to the mudline where it is connected to a terminator and terminator extension.

In order to provide tension in the riser pipe, which is necessary to provide the properly controlled motion of the VMP, an axial or thrust bearing may be provided between the terminator and the encircling sleeve, so that the tension in the riser pipe can be transmitted to the jacket of the VMP. A first or lower horizontal bearing is provided between the terminator and sleeve.

In accordance with our invention the upper short end of the first or long terminator is connected to a short length of riser pipe and then to a second or "short" terminator structure which is connectd to surface equipment on the deck of the VMP. A second or upper horizontal bearing is attached between the sleeve inside a leg of a VMP and the second smaller terminator so that the pipe passing through the two horizontal bearings can be deflected at each point. Thus the total deflection by this type of rotation support will permit a reduction in stress along the pipe, from the long terminator up to the surface, without providing a very large deflection in the vicinity of the first or lower horizontal bearing.

There are two restraints in the design of the terminator and terminator extension. One is that the stress must be everywhere less than a maximum allowable value which is dependent on the multiterminator material. The second constraint is that the extension of the terminator inside the sleeve must not be deflected far enough from the axis of the sleeve so as to touch the wall of the sleeve, in which case the normally accepted method of mathematical calculations concerning the multiterminator would not apply and there could be additional stresses on the sleeve which would be undesirable.

By the use of a terminator extension, the combined length, weight and cost of the terminator and extension is much less than in the case where the terminator is used alone.

As mentioned, the terminator and extension must be supported in a sleeve inside the jacket (or leg) of the VMP and a thrust bearing of some design must be provided so as to maintain the riser pipe in tension. We have found that an increased flexibility can be provided if the lateral restraints of the horizontal bearings are flexible, in the sense that the pipe can bend in a vertical plane about the center of the horizontal bearing which then acts as a buffer against which the pipe is being bent and the two ends are pressed in a direction opposite the thrust of the bearing.

BRIEF DESCRIPTION OF THE DRAWINGS

These and other objects and advantages of this invention and a better understanding of the principles and details of the invention will be evident from the following description taken in conjunction with the appended drawings, in which.

DETAILED DESCRIPTION OF THE PREFERRED EMBODIMENT

Figure 1:
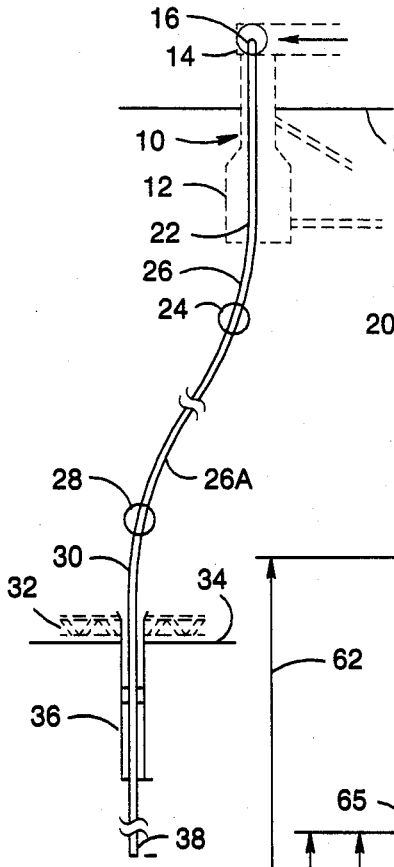
FIG. 1 PRIOR ART
FIG. 1 illustrates schematically a complete section of the riser pipe, from below the mudline up through the sea and up into the jacket of a vertically moored platform showing the type of curvature that is experienced.

Referring now to the drawings and in particular to FIG. 1, there is shown a simple diagram of a vertically moored platform (VMP) indicated generally by the numeral 10 having a jacket leg 12 into which is inserted, through the bottom, a riser pipe 26 which is in effect a continuation of a pipe or casing 38 which is anchored below the mudline after passing through conductor casing 36. The bottom anchor of the riser pipe is such that it can support the tension which will be required to hold the vertically moored platform in position on the sea surface.

At the point 22 there is a horizontal bearing for transmitting lateral or horizontal forces, and at point 14 there is a vertical bearing for transmission of axial forces.

There are flexure zones 24 and 28 within the length of the riser pipe near the platform and the mudline, respectively. The portion 26A between the flexure point is substantially straight but non-vertical, while the riser pipe is vertical in the earth and is vertical inside the platform leg. Thus bending is concentrated where the curvature is shown just below the platform leg and just above the well template 32 which rests on the mud surface 34.

The object of the terminator is not only to anchor the riser pipe at the platform but also to design the anchor mechanism so as to properly provide the necessary curvature shown in FIG. 1 without stressing the pipe or terminator and other tubular members, that may be inside the riser, more than a selected maximum.

Figure 2:
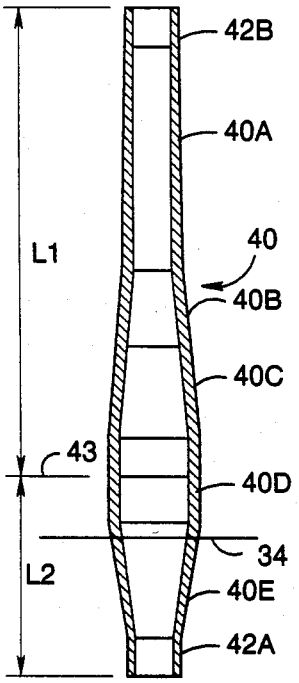
FIG. 2 PRIOR ART
FIG. 2 illustrates a general design for a terminator.

FIG. 2 illustrates a typical prior art design of a terminator, which is joined at its two ends 42A and 42B, to riser pipes extending upwardly and downwardly. The terminator is designated generally by the numeral 40 and has a cylindrical portion 40D of selected length and diameter which tapers off through appropriate conical pipes 40E going down to the riser pipe, and various sections 40C, 40B, 40A, etc. going upwardly to the riser pipe. As shown on the drawing, the inner diameter and outer diameter vary throughout the length of the terminator, while one is constant the other varies and vice versa, or both vary simultaneously depending upon the most convenient way to design and construct the device. There is no precise dimension for the overall length of the terminator. It can have the two ends of equal length or have a longer portion in one direction, length L1, and a shorter portion of length L2 in the other direction. The reason that this is preferred is that in the end which is joined to pipe inside a containig pipe or sleeve, the amount of deflection that can be permitted is less than the other long end L1, where the pipe is in the water and has no lateral constraint. If the design were symmertical about the anchor point 43, then the deflection would be symmetrical on each side of the point, and the design of the terminator would be symmetrical also.

The mathematics for determining lateral deflection of a vertically suspended pipe are well known. The system can be described by the following beam column differential equation:

$$\frac{d^2}{dx^2}\left[E(x)I(x)\frac{d^2y(x)}{dx^2}\right]+\frac{d}{dx}\left[P(x)\frac{dy(x)}{dx}\right]=0$$

where:

E(x)=modulus of elasticity,

I(x)=moment of intertia,

P(x)=axial load, y(x)=lateral deflection, and x=location along the length of the beam column.

By applying the kwown boundary conditions of a system, the differential equation can be solved such as to satisfy all required conditions. Such required conditions can include stress level, lateral deflection limits, or structural section size and/or configuration.

Figure 3:
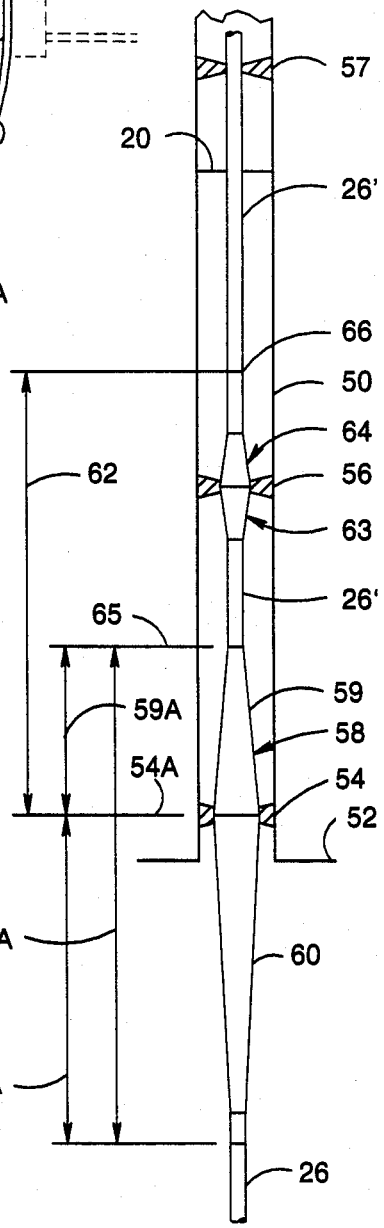
FIG. 3 illustrates the construction of a terminator and terminator extension of our invention, positioned inside a jacket leg with proper horizontal bearings.
Figure 6:
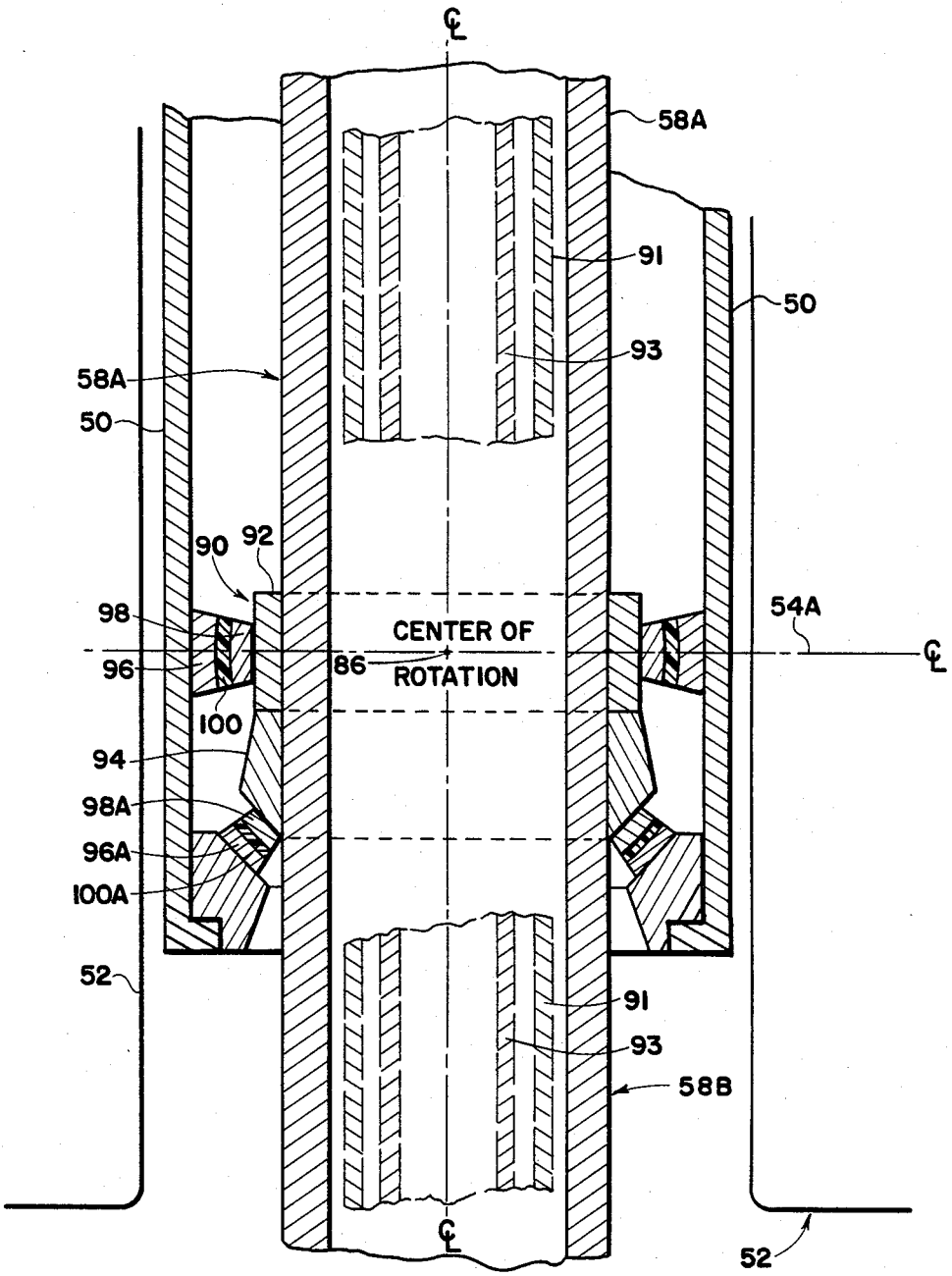
FIG. 6 illustrates a combination horizontal and thrust bearing for positioning the terminator in the jacket leg.

Referring now to FIG. 3, there is shown in schematic outline a construction of a novel multiterminator having a terminator indicated generally by the numeral 58 and a termination extension generally indicated by numeral 64. Terminator 58 has a short leg 59 and a long leg 60. The long leg is directed downwardly and joins a length of riser pipe 26. The mid section, which is preferably not in the center of the terminator is held in horizontal bearing 54. This bearing 54 provides a lateral restraint for the terminator 58. If bearing 54 is modified as shown in FIG. 6, it can also provide for axial force transmission. As previously indicated, the lengths of the short and long ends 59A and 60A preferably are not equal and may roughly be defined in a ratio of approximately 1:2. The overall length can vary depending on the size and dimensions of the pipes, etc., and the tension required. The terminator 58 is provided with horizontal support at the lower bearing 54 which will be discussed in connection with FIG. 6. The length of the terminator extension is indicated by the numeral 62 and is a portion of the assembly reaching from the point of bearing 54 of the terminator 58 to the point 66, above the second horizontal bearing 56. The length of the terminator 58 is indicated by 58A. A suitable horizontal bearing is shown in U.S. Pat. No. 4,130,995 entitled "VMP Riser Horizontal Bearing" issued on Dec. 26, 1978.

Sleeve 50 forms an inner opening through the jacket leg 12 through which the riser pipe enters up into the drilling and producing portions of the platform. The top of the short leg 59 goes to a short length 26' of the riser pipe which is connected to a "short" terminator 63 that has a double-ended, substantially symmetrical, tapered section 64, which is provided with horizontal bearing 56 inside sleeve 50. Riser pipe section 26' and short terminator 63 and terminator end 58 form what can be called a terminator extension 62. That portion of FIG. 3 indicated by sections 60A and 62 can be called a "multiterminator". The upper end 66 of the terminator extension is roughly set at the point where there is little or no bending moment in the pipe 26''. The riser pipe 26'' then goes upwardly through a vertical bearing 57, which permits sliding contact of very small amounts which occur as the curvature of the pipe 26 varies. However, since the motion of the pipe 26'' through the vertical bearing 56 is very small, the construction can be simple friction contact. A suitable vertical bearing 57 can be such as shown in U.S. Pat. No. 4,127,005 entitled "Riser/Jacket Vertical Bearing Assembly for Vertically Moored Platform" issued Nov. 28, 1978.

Figure 4:
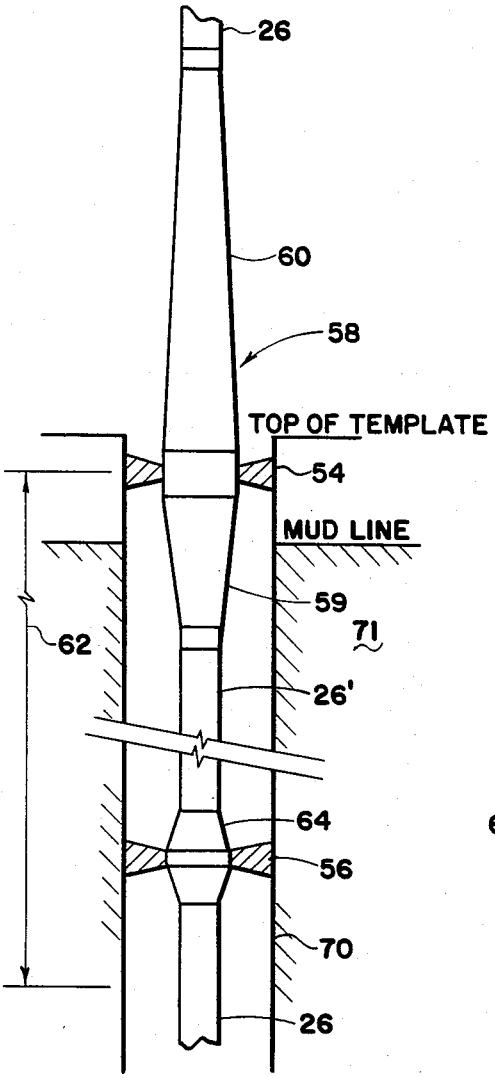
FIGS. 4 and 5 show schematically the arrangement of the terminator extensions respectively at the mudline, and inside the jacket leg.
Figure 5:
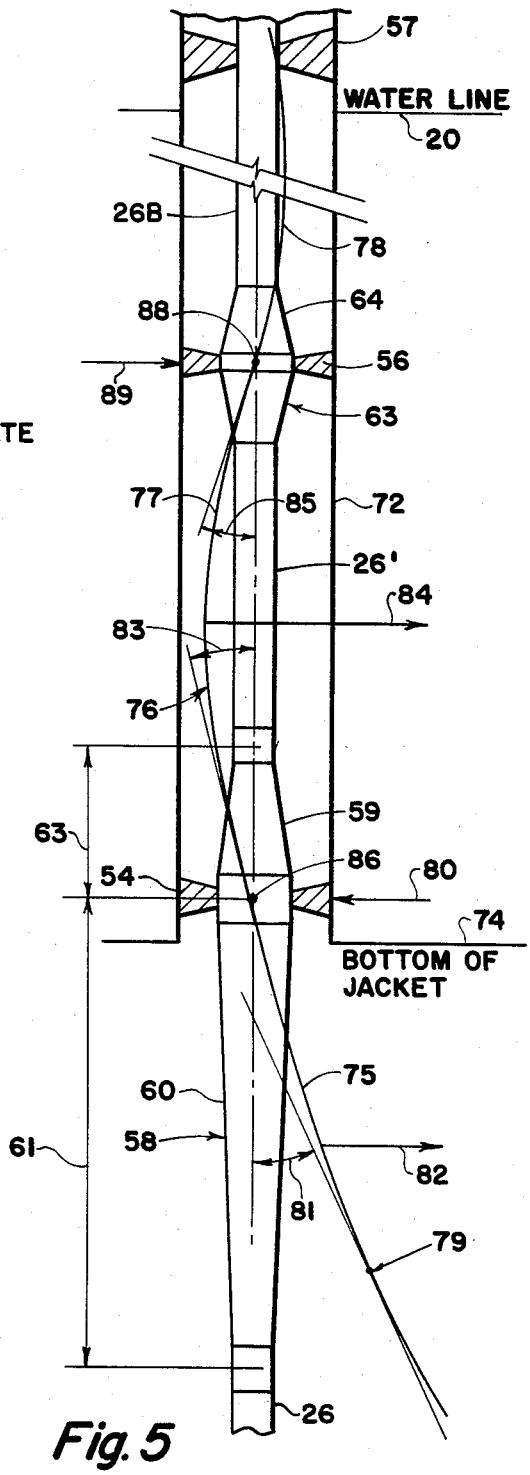

Referring to FIGS. 4 and 5, FIG. 4 shows the lower end of the riser pipe as it is anchored to the conductor pipe 70, which is anchored in the earth 71. The principal terminator 58 with legs 60 and 59, are the same as illustrated in FIG. 3 and the section of riser pipe 26' and also the second terminator 64 and horizontal bearings 56 and 54 are all as shown in FIG. 3, except that at the lower end of the pipe, the terminator is inverted with respect to the upper end of the anchoring at the VMP.

FIG. 5 is similar except that it is now in the same direction of installation as in FIG. 3, with the long leg 60 of the principal terminator pointed downwardly into the water, while the short end is connected through a section of riser pipe 26A and the short terminator 63 and the pipe 26B going up through the vertical bearing 57.

The curved line 76 which passes through the center 86 of the lower horizontal bearing 54 and also through the center 88 of the upper horizontal bearing 56 would illustrate in an exaggerated fashion, the curvature of the structure of FIG. 5 when there is a deflection, for example, of the VMP to the left. The lower portion 75 of the curve is deflected to the right of the upper portion 76 of the curve as the jacket tends to move to the left. The terminator rotates, i.e., angularly deflects inside bearing 54. Again, the upper terminator 64 angularly deflects a small amount in its bearing 56 in a reverse direction with decreasing amplitude over the amplitude in the section between the two terminators. Thus the curvature would be greatest at the lower end 75, less on the top 77 of the lower 58 terminator and lower still 78 above the smaller terminator 64.

The arrow 80 is shown as the direction of the force being applied by the platform to the riser pipe through the horizontal bearing 54. The lower portion of the riser pipe is anchored in the earth and the earth provides a restraining force 82. There is also a restraining force 89 applied above the lower terminator by a horizontal force applied at the upper bearing 56.

Any type of bearing support 54 may be used between the upper terminator 63 and the platform leg, as previously mentioned, so long as it provides for a bending in any vertical plane through the leg of the jacket of the VMP. It is also necessary to provide a tension in the riser pipe below the lower bearing 54. A bearing of the type shown in FIG. 6 provides for transmission of both vertical and horizontal forces.

The direction of portion 75 of the line 79 in FIG. 5 makes an angle 81 with the axis of sleeve 72. The direction of the line 79 above the lower bearing 54 makes an angle 83. The lower terminator 58 mid section angularly deflects about point 86 to be tangent to this curve. Angle 83 is smaller than 81. Again, the upper terminator 63 will rotate about point 88 to be tangent to the line 79 at 88. There will be a smaller deflection 78 of the pipe above the upper terminator. Thus, by providing the multiple terminators (there could be a third and fourth one above the top terminator 63, now shown), each in its own rotary bearing 54, 56, a much greater deflection angle 81 can be provided without increasing the stress in the riser pipe.

Bearing 54 of FIG. 3 can be a fixture such as shown in FIG. 6. This indicates a fixture 90 surrounding the pipe 58B which is the cylindrical center portion of the terminator 58. This fixture indicated generally by the numeral 90, has two rings, an upper ring 92, and a lower ring 94. Point 86 represents the center of the spherical portions. The horizontal bearing centerline 54A will pass through that center 86. The bearing elements are essentially an outer steel base ring 96 and an inner steel ring 98 supported by ring 92. Ring 98 is attached to ring 92 and its outer surface is spherical. The inner surface of the outer portion 96 which is attached to the sleeve 50 is also spherical and the center shell portion 100 is a resilient elastomeric compliant material, which is bonded to the spherical surfaces of the portions 98 and 96. Thus the two surfaces 98 and 96 have limited movement to rotate about the center 86 with respect to each other, while the inner material 100 moves in a shearing action, so that a substantially frictionless rotation is possible over a limited angle.

The lower spherical bearing has an inner ring 98A and an outer ring 96A, with a corresponding intermediate portion 100A. This is an alternate means to provide the thrust transmission means required to maintain the tension in the riser pipe, but still permits the rotational feature controlled by the horizontal bearings 54. The bearing rings 98A, 96A, and 100A are supported on ring 94. The center of the spherical surfaces 98A, 96A is at point 86.

While the success of the bearing, such as the one illustrated in FIG. 6, is important to the success of the entire anchoring system, including the terminator and the terminator extension; and while the design shown in FIG. 6 may be preferred, other designs can, of course, be used provided they meet all of the motion and stress requirements, and utilize flexibility of the terminator extension previously described.

The upper bearing 56 of FIG. 5, which supports the upper terminator 63, is not required to take thrust. Therefore, bearing 56 may simply be the horizontal bearing portion 92 of the bearing assembly shown in FIG. 6. This would include the ring 92, the two spherical rings 98 and 96 and the compliant shell 100.

Ring 98 has an outer surface which is spherical, centered at point 86. Ring 96 has an inner surface which is spherical, also centered at point 86. Point 86 is on the axis of the terminator and sleeve 50. It also lies on the central horizontal plane 54A through the rings 98, 96. The spherical surfaces of the rings 98 and 96 are spaced apart a selected distance, and this space is filled with a selected elastomeric material, which is preferably bonded to both spherical surfaces.

The two portions of the bearing assembly lateral bearing 92 and thrust bearing 94 are mounted on a rigid internal pipe 58B, which comprises the cylindrical mid-section of the principal terminator 58. The tubular members 91, shown by dashed lines, represent one of a plurality of casings which may lie in the annulus between the innermost casing or conductor pipe 93. These are all substantially co-axial pipes, and form another reason for limiting the maximum stress and deflection at all points along the riser pipe.

We have shown in FIGS. 3 and 5 a complete set of bearings for the multiterminator or terminator extension of this invention. In FIG. 6 we have shown the thrust bearing 94 as a part of an assembly with one of the lateral bearings 92. However, it is equally possible to apply the thrust bearing widely spaced from the lateral bearings.

With the thrust bearing widely spaced from the lateral bearings, a lateral bearing is required which has a combination of rotary and sliding motion. Such a bearing is illustrated in FIG. 5 of U.S. Pat. No. 4,130,995 which has a portion 48 which combines an outer cylindrical surface 82 with an inner spherical surface 56.

We have described a multiterminator which is an improvement in the anchoring mechanism by which a riser pipe is attached in a vertical manner inside a jacket leg of a vertically moored platform or other floating structure. The same construction can also be utilized at the lower anchorage of the riser pipe with the earth. By the use of the terminator and terminator extension (multiterminator), it is possible to maintain a greater total angular deflection of the pipe without providing any greater maximum value of stress in the pipe at any point.

The required length and weight of the prior art terminator and of the multiterminator of our invention were calculated using known tension beam equations for the following design conditions of an offshore location.

Water depth—1000 feet
Wind—130 knots
Wave—90 feet maximum; 13.5 second period
Current—4.4 feet/second
Riser outside diameter—18.625 inches
Riser wall thickness—0.625 inches
Pre-tension per riser—600,000 pounds
Maximum tension at top of riser—2,000,000 pounds
Diameter of sleeve 50 in jacket leg through which riser passes—45 inches
Diameter of piles or conductor pipes 70 in sea floor through which riser extends—40 inches
Maximum allowable outer fiber stress—65,000 pounds/sq. in.

The following table shows the results of our calculations comparing the length and weight of our multiterminator (as indicated in FIG. 3) and the prior art terminator (as indicated in FIG. 2) in which the outer fiber stress from the combined effects of axial tension and bending moment is equal to the maximum allowable value along the entire length of the terminator assembly.

| | Length (Prior Art terminator) | Length (Multi-terminator) | Weight (Prior art terminator) | Weight (Multi-terminator) |
|---|---|---|---|---|
| Upper Assembly | 176 ft. | 106 ft. | 83,300 lbs | 42,700 lbs |
| Lower Assembly | 176 ft. | 127 ft 6 in | 127,000 lbs | 90,800 lbs |

This reduction in overall length and total weight is most important. For example, these terminators will have to be manufactured at specially equipped fabrication centers and shipped and installed as a unit. The reduction in length and weight of multiterminators using our invention makes the offshore installation much more practical and in some cases permits installations which might otherwise be prohibited because of the size of terminator required under the prior art system.

While we have described this invention as related to the vertically moored platform, for which it is admirably suited, it can also be used with other types of floating structure.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed:

1. A multiterminator assembly for use with a riser pipe used to anchor a floating structure, comprising:

(a) a first terminator comprising a tubular assembly, having a mid-section of cylindrical shape and selected length and diameter, with two conical end portions; a first conical end portion of lesser conical angle and greater length than the second conical end portion;

(b) a vertical tubular sleeve attached to and downwardly depending from said floating structure and carrying a first horizontal bearing at the level of said mid-section of the first terminator;

(c) the first conical end portion of said first terminator connected to the top end of said riser pipe which is anchored at its bottom end in the earth below the mudline;

(d) a second terminator having two conical end portions;

(e) the second conical end portion of said first terminator connected to a first length of riser pipe which is connected to a first end of said second terminator; the second end of said second terminator connected by a second length of riser pipe to the floating structure; and (f) a second bearing carried inside said tubular sleeve at the level of said second terminator.

2. The assembly as in claim 1 in which said first bearing includes a horizontal bearing element and an axial bearing element.

3. A multiterminator assembly for use with a riser pipe used to anchor a floating structure to the seafloor, comprising:

(a) a first terminator comprising a tubular assembly having a first conical end portion of lesser conical angle and greater length than a second conical end portion;

(b) the first conical end portion of the first terminator being connected to one end of the riser pipe;

(c) a tubular sleeve for attachment to the floating structure or the seafloor and adapted to receive the first terminator therethrough, and carrying a first bearing at the level of the first terminator;

(d) a second terminator having two conical end portions;

(e) the second conical end portion of the first terminator being connected to a length of riser pipe connected to a first conical end portion of the second terminator, and a second conical end portion of the second terminator being connected to a second length of riser pipe; and (f) a second bearing carried by the tubular sleeve at the level of the second terminator.

4. The multiterminator assembly as in claim 3 wherein the first bearing includes a horizontal bearing element and an axial bearing element.

5. The multiterminator assembly as in claim 3 and including a third bearing carried by the tubular sleeve at the level of the second length of riser pipe.

6. A bearing assembly for supporting a rigid tubular member, comprising:

(a) a tubular sleeve adapted for receiving the rigid tubular member therethrough;

(b) a first bearing attached to the interior of the tubular sleeve and having an outer surface where every point is an equal distance R1 from the center of rotation of the tubular member; and (c) a second bearing attached to the interior of the tubular sleeve at a position within the horizontal plane passing through the center of rotation of the tubular member and having an outer surface where every point is an equal distance R2, which is less than R1, from the center of rotation of the tubular member.

7. The bearing assembly of claim 6 wherein the first bearing and second bearing each include:

a base ring attached to the interior of the tubular sleeve;

an inner ring cooperable with the tubular member; and compliant material connected between the base ring and the inner ring.

8. The bearing assembly of claim 7 and including:

a thrust bearing ring for connection to the tubular member at a position spaced from the horizontal plane of the center of rotation of the tubular member, and cooperable with the inner ring of the first bearing, and a lateral bearing ring for connection to the tubular member at a position lying within the horizontal plane passing through the center of rotation of the tubular member, and cooperable with the inner ring of the second bearing.

9. The bearing assembly of claim 8 wherein the thrust bearing ring and the lateral bearing ring are formed as a single piece for connection to the tubular member.

* * * * *